US011200842B2

(12) United States Patent
Dong

(10) Patent No.: US 11,200,842 B2
(45) Date of Patent: Dec. 14, 2021

(54) PIXEL DRIVING CIRCUIT AND DRIVING METHOD THEREFOR, DISPLAY PANEL, AND DISPLAY DEVICE

(71) Applicant: BOE Technology Group Co., Ltd., Beijing (CN)

(72) Inventor: Tian Dong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/916,701

(22) Filed: Jun. 30, 2020

(65) Prior Publication Data

US 2021/0012713 A1 Jan. 14, 2021

(30) Foreign Application Priority Data

Jul. 9, 2019 (CN) ..... 201910615582.7

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01)

(58) Field of Classification Search
CPC ... G09G 3/3233; G09G 3/3266; G09G 3/3291
See application file for complete search history.

(56) References Cited

U.S. PATENT DOCUMENTS 8,044,893 B2 10/2011 Nathan et al.
8,497,825 B2 7/2013 Nathan et al.
8,659,518 B2 2/2014 Nathan et al.
9,373,645 B2 6/2016 Nathan et al.
9,728,135 B2 8/2017 Nathan et al.
10,262,596 B2 4/2019 Sano et al.
10,311,793 B2 6/2019 Chai et al.
10,431,157 B2 10/2019 Cai
10,733,938 B2 8/2020 Chai et al.
10,777,124 B1 * 9/2020 Chen ..... G09G 3/32
(Continued)

FOREIGN PATENT DOCUMENTS

CN 101826298 A 9/2010
CN 107342052 A 11/2017
(Continued)

OTHER PUBLICATIONS

Office Action dated May 21, 2020, issued in counterpart CN Application No. 201910615582.7, with English Translation. (26 pages).

*Primary Examiner* — Stacy Khoo
(74) *Attorney, Agent, or Firm* — Westerman, Hattori, Daniels & Adrian, LLP

(57) ABSTRACT

Embodiments of the present disclosure provide a pixel driving circuit and a driving method thereof, a display panel, and a display device. The pixel driving circuit comprises: a driving transistor connected to a first node, a first power supply voltage terminal and one end of a light emitting unit; a switching subcircuit connected to a first scanning terminal, the first node and a data voltage terminal; and a compensation subcircuit connected to the first node, a second scanning terminal, a first voltage terminal and a reference voltage terminal.

15 Claims, 7 Drawing Sheets

(56) References Cited

U.S. PATENT DOCUMENTS

| | | | |
|---|---|---|---|
| 2006/0187153 | A1 | 8/2006 | Nathan et al. |
| 2012/0001888 | A1 | 1/2012 | Nathan et al. |
| 2013/0293522 | A1 | 11/2013 | Nathan et al. |
| 2014/0132581 | A1 | 5/2014 | Nathan et al. |
| 2016/0267846 | A1 | 9/2016 | Nathan et al. |
| 2017/0337872 | A1 | 11/2017 | Chai et al. |
| 2018/0068619 | A1 | 3/2018 | Sano et al. |
| 2019/0074340 | A1 | 3/2019 | Cai |
| 2019/0251906 | A1 | 8/2019 | Chai et al. |
| 2020/0320936 | A1 | 10/2020 | Chai et al. |

FOREIGN PATENT DOCUMENTS

| | | | |
|---|---|---|---|
| CN | 107403608 | A | 11/2017 |
| CN | 107808629 | A | 3/2018 |

* cited by examiner

PIXEL DRIVING CIRCUIT AND DRIVING METHOD THEREFOR, DISPLAY PANEL, AND DISPLAY DEVICE

CROSS-REFERENCE TO RELATED APPLICATION

This application claims the benefit of Chinese Patent Application No. 201910615582.7 filed on Jul. 9, 2019, the whole disclosure of which is incorporated herein by reference.

TECHNICAL FIELD

The present disclosure relates to the field of display technology, and in particular to a pixel driving circuit and a driving method therefor, a display panel, and a display device.

BACKGROUND

Organic light emitting diode (OLED) displays have advantages of self-illumination, light weight, low power consumption, high contrast, high color gamut, flexible displaying, and the like, thus attracted much attention in market. Among them, active-matrix OLED (AMOLED) display panels have been widely used in various electronic devices including computers, mobile phones and other electronic products due to their advantages of low driving voltage and long life of light emitting components. However, AMOLED display panels have a problem of uneven brightness of display screen.

SUMMARY

Embodiments of the present disclosure provide a pixel driving circuit and a driving method therefor, a display panel, and a display device.

An embodiment of the present disclosure provides a pixel driving circuit, comprising: a driving transistor having a gate connected to a first node, a first electrode connected to a first power supply voltage terminal, and a second electrode connected to one end of a light emitting unit, the driving transistor being configured to generate a driving current that causes the light emitting unit to emit light under control of a voltage of the first node; a switching subcircuit connected to a first scanning terminal, the first node and a data voltage terminal, the switching subcircuit being configured to write a data voltage of the data voltage terminal into the first node under control of a voltage of the first scanning terminal; a compensation subcircuit connected to the first node, a second scanning terminal, a first voltage terminal and a reference voltage terminal, the compensation subcircuit being configured to: control the voltage of the first node under control of a voltage of the second scanning terminal, so as to turn off the driving transistor; adjust the data voltage written into the first node by the switching subcircuit to an intermediate control voltage associated with a threshold voltage of the driving transistor under control of voltages of the second scanning terminal, the first voltage terminal and the reference voltage terminal; and adjust the voltage of the first node from the intermediate control voltage to a compensation data voltage under continuous control of a voltage of the second scanning terminal, so as to cause the driving transistor to generate the driving current.

In some embodiments, the compensation subcircuit comprises: a first compensation control subcircuit connected to the second scanning terminal and the first node; and a second compensation control subcircuit connected to the first node, the first voltage terminal and the reference voltage terminal.

In some embodiments, the first compensation control subcircuit comprises a first capacitor having a first electrode connected to the second scanning terminal and a second electrode connected to the first node.

In some embodiments, the second compensation control subcircuit comprises: a second capacitor having a first electrode connected to the first voltage terminal and a second electrode connected to a first electrode of a first transistor; and the first transistor having a gate connected to the reference voltage terminal and a second electrode connected to the first node.

In some embodiments, the first capacitor has capacitance equal to that of the second capacitor.

In some embodiments, the first transistor has a threshold voltage the same as that of the driving transistor.

In some embodiments, the first transistor has size and parameters the same as that of the driving transistor.

In some embodiments, the light emitting unit is an organic light emitting diode having an anode connected to the second electrode of the driving transistor and a cathode connected to a second power supply voltage terminal.

In some embodiments, the switching subcircuit comprises a second transistor having a gate connected to the first scanning terminal, a first electrode connected to the data voltage terminal, and a second electrode connected to the first node.

An embodiment of the present disclosure further provides a display panel comprising the pixel driving circuit of the above-described embodiments.

An embodiment of the present disclosure further provides a display device comprising the display panel of the above-described embodiments. An embodiment of the present disclosure further provides a driving method of a pixel driving circuit. The pixel driving circuit comprises: a driving transistor having a gate connected to a first node, a first electrode connected to a first power supply voltage terminal, and a second electrode connected to one end of a light emitting unit, the driving transistor being configured to generate a driving current that causes the light emitting unit to emit light under control of a voltage of the first node; a switching subcircuit connected to a first scanning terminal, the first node and a data voltage terminal, the switching subcircuit being configured to write a data voltage of the data voltage terminal into the first node under control of a voltage of the first scanning terminal; a compensation subcircuit connected to the first node, a second scanning terminal, a first voltage terminal and a reference voltage terminal, the compensation subcircuit being configured to: control the voltage of the first node under control of a voltage of the second scanning terminal, so as to turn off the driving transistor; adjust the data voltage written into the first node by the switching subcircuit to an intermediate control voltage associated with a threshold voltage of the driving transistor under control of voltages of the second scanning terminal, the first voltage terminal and the reference voltage terminal; and adjust the voltage of the first node from the intermediate control voltage to a compensation data voltage under continuous control of a voltage of the second scanning terminal, so as to cause the driving transistor to generate the driving current. The driving method comprises: during a reset phase: inputting a second scanning signal to the second scanning terminal, and controlling, by the compensation subcircuit, the voltage of the first node so as to turn off the driving transistor; during a pixel data writing phase: continuously inputting the second scanning signal to the second scanning terminal; inputting a first scanning signal to the first scanning terminal, and inputting, by the switching subcircuit, the data voltage inputted via the data voltage terminal to the first node; during a light emitting phase: inputting an inversed-phase voltage of the second scanning signal to the second scanning terminal, and adjusting, by the compensation subcircuit, the data voltage written into the first node by the switching subcircuit to an intermediate control voltage associated with a threshold voltage of the driving transistor under control of voltages of the second scanning terminal, the first voltage terminal and the reference voltage terminal; and adjusting the voltage of the first node from the intermediate control voltage to a compensation data voltage under continuous control of a voltage of the second scanning terminal, so as to cause the driving transistor to generate the driving current.

In some embodiments, in the case where the compensation subcircuit in the pixel driving circuit comprises the first compensation control subcircuit and the second compensation control subcircuit, inputting the second scanning signal to the second scanning terminal, and controlling, by the compensation subcircuit, the voltage of the first node so as to turn off the driving transistor comprises: inputting the second scanning signal to the second scanning terminal, and controlling, by the first compensation control subcircuit, the voltage of the first node so as to turn off the driving transistor; inputting an inversed-phase voltage of the second scanning signal to the second scanning terminal, and adjusting, by the compensation subcircuit, the data voltage written into the first node by the switching subcircuit to an intermediate control voltage associated with a threshold voltage of the driving transistor under control of voltages of the second scanning terminal, the first voltage terminal and the reference voltage terminal; and adjusting the voltage of the first node from the intermediate control voltage to a compensation data voltage under continuous control of a voltage of the second scanning terminal, so as to cause the driving transistor to generate the driving current comprises: inputting the inversed-phase voltage of the second scanning signal to the second scanning terminal, and adjusting, by the first compensation control subcircuit and the second compensation control subcircuit, the data voltage written into the first node by the switching subcircuit to an intermediate control voltage associated with a threshold voltage of the driving transistor under control of voltages of the second scanning terminal, the first voltage terminal and the reference voltage terminal; and adjusting, by the first compensation control subcircuit, the voltage of the first node from the intermediate control voltage to a compensation data voltage under continuous control of a voltage of the second scanning terminal, so as to cause the driving transistor to generate the driving current to drive the light emitting unit to emit light, and compensate for the threshold voltage of the driving transistor.

In some embodiments, a value of the data voltage meets:

$$Vth+V_{ELVDD} \leq Vdata \leq \frac{1}{2}(V_{init}+V_{ELVDD})$$

wherein, Vdata represents the data voltage, Vth represents the threshold voltage of the driving transistor, $V_{ELVDD}$ represents the voltage of the first power supply voltage terminal, and $V_{init}$ represents the voltage of the second scanning terminal.

In some embodiments, a value of the data voltage meets:

$$V_{ref}-Vth' \leq Vdata \leq \frac{1}{2}(V_{ref}+V_{init})-Vth'$$

wherein, Vdata represents the data voltage, $V_{ref}$ represents the voltage of the reference voltage terminal, Vth' represents a threshold voltage of a first transistor, and $V_{init}$ represents the voltage of the second scanning terminal.

BRIEF DESCRIPTION OF THE DRAWINGS

In order to explain the technical solutions of the embodiments of the present disclosure more clearly, the drawings required in the description of the embodiments will be briefly introduced below. Obviously, the drawings in the following description are only some embodiments of the present disclosure. Those skilled in the art can obtain other drawings based on these drawings without inventive effort.

DETAILED DESCRIPTION

Figure 1:
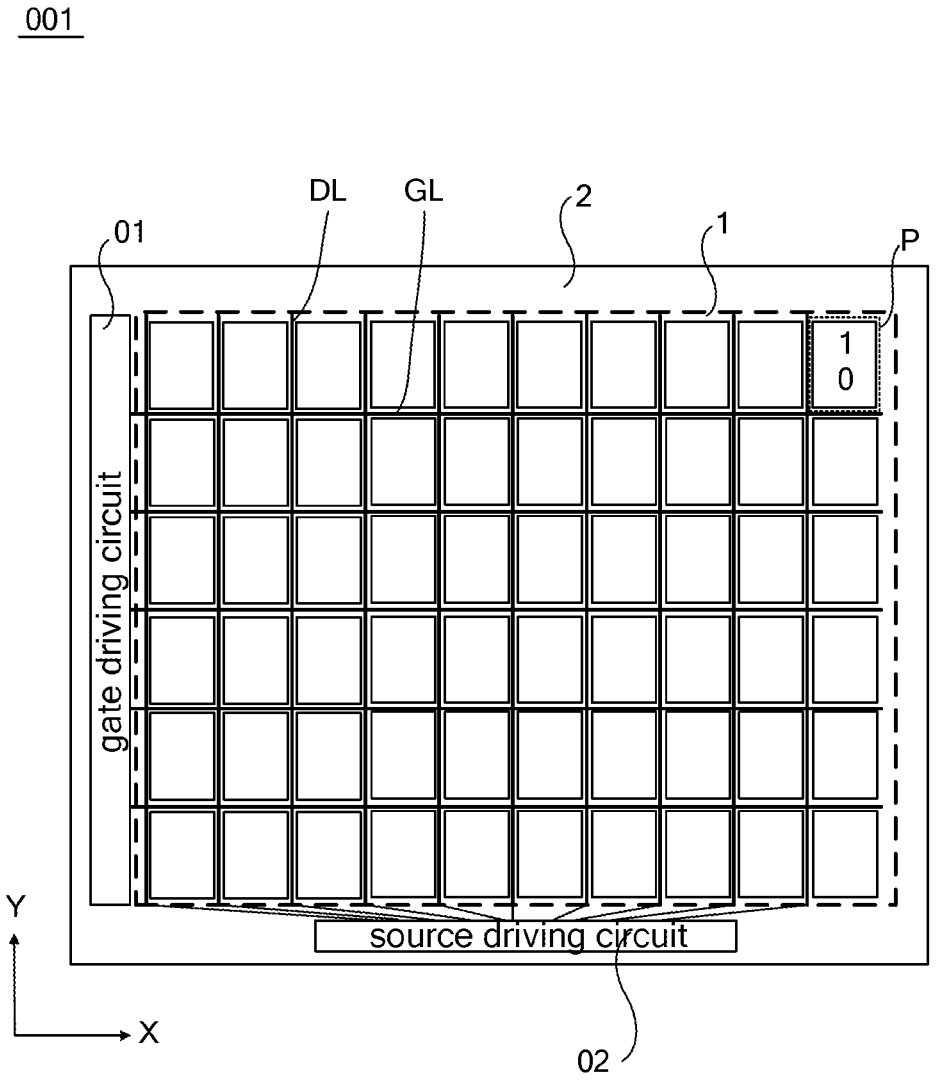
FIG. 1 is a schematic structural diagram of a display panel provided by an embodiment of the present disclosure.

The technical solutions in the embodiments of the present disclosure will be described clearly and completely in combination with the drawings in the embodiments of the present application. Obviously, the described embodiments are only a part of the embodiments of the present disclosure, not all the embodiments. Based on the embodiments of the present disclosure, all other embodiments obtained by those ordinary skilled in the art without inventive effort fall within the protection scope of the present disclosure.

Unless otherwise defined, the technical terms or scientific terms used in the embodiments of the present application shall have the common meanings understood by persons with general skills in the field to which the present disclosure belongs. The words "first", "second" and similar words used in the embodiments of the present disclosure do not indicate any order, quantity or importance, but are only used to distinguish different components. The word "including", "comprising" or a similar word means that the element or object appearing before the word covers the element or object listed after the word and its equivalents, but does not exclude other elements or objects. The words "connected", "coupled" and similar words are not limited to physical or mechanical connections, but may include electrical connections, whether direct ones or indirect ones.

In addition, in this application, directional terms such as "upper", "lower", "left", "right", "horizontal", and "vertical" are defined relative to the orientation in which the components in the drawings are schematically placed. It should be understood that these directional terms are relative concepts, and they are used for relative description and clarification, which can be changed correspondingly according to changes in the orientations in which the components are placed in the drawings.

An embodiment of the present disclosure provides a display device, which may be a television, a mobile phone, a computer, a notebook computer, a tablet computer, a personal digital assistant (PDA), a vehicle computer, or the like.

The display device comprises a frame, a display panel provided in the frame, a circuit board, a display driver IC, and other electronic accessories.

The display panel may be: an Organic Light Emitting Diode (OLED) display panel, a Quantum Dot Light Emitting Diode (QLED) display panel, a Micro Light Emitting Diode (Micro LED) display panel, or the like, which is not specifically limited in the present disclosure.

The following embodiments of the present disclosure all describe the present disclosure by taking an OLED display panel as an example.

As shown in FIG. 1, a display panel 001 comprises: an active area 1 (AA for short, also referred to as an effective active area) and a peripheral area 2 provided around the active area 1.

The display panel 001 includes sub pixels P of various colors in the active area 1. The sub pixels P of various colors at least comprise a first color sub pixel, a second color sub pixel, and a third color sub pixel, where the first color, the second color, and the third color are three primary colors (such as red, green and blue). Each of the sub pixels P is provided with a pixel driving circuit (also referred to as a pixel circuit).

For convenience of explanation, the plurality of sub pixels P in the present disclosure are described with matrix arrangement as an example. In this case, the sub pixels P arranged in a row along the horizontal direction X are referred to as the same row of sub pixels, and the sub pixels P arranged in a row along the vertical direction Y are referred to as the same column of sub pixels.

Based on this, the pixel driving circuits in the same row of sub pixels P are connected to the same gate line GL, and the pixel driving circuits in the same column of sub pixels P are connected to the same data line DL.

Based on this, as shown in FIG. 1, the display panel 001 is provided with a gate driving circuit 01 connected to the gate line GL and a data driving circuit 02 connected to the data line DL in the peripheral area 2. During displaying, the pixel driving circuits connected to the gate line GL are turned on row by row by the gate driving circuit 01, and the data driving circuit 02 writes the data voltage into the pixel driving circuits 10 through the data line DL when the pixel driving circuits connected to the same gate line GL are turned on, so as to drive the display panel 001 to display screen.

In some embodiments, the gate driving circuit 01 may be arranged on a side in an extending direction of the gate line GL in the peripheral area 2, and the data driving circuit 02 may be arranged on a side in an extending direction of the data line DL in the peripheral area 2.

In some embodiments, in order to reduce the manufacturing cost of the display panel and narrow the frame width, the gate driving circuit 01 may be set as a GOA (Gate Driver on Array) circuit, that is, the gate driving circuit 01 is directly integrated in an array substrate of the display panel 001.

Figure 2:
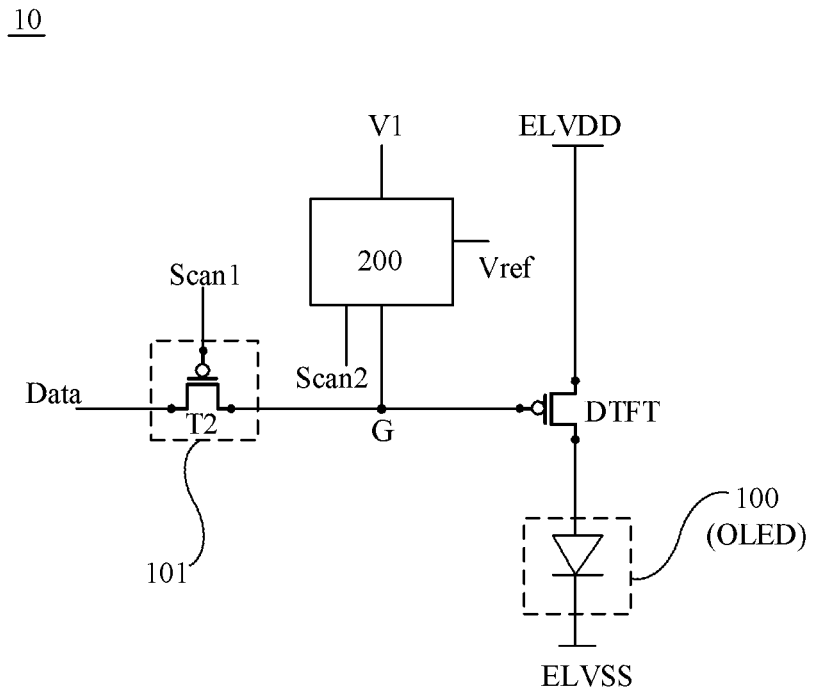
FIG. 2 is a schematic diagram of a pixel driving circuit provided by an embodiment of the present disclosure.

The pixel driving circuit in above embodiment will be described below. FIG. 2 is a schematic diagram of the pixel driving circuit 10 provided by an embodiment of the present disclosure.

As shown in FIG. 2, it can be understood by those skilled in the art that the pixel driving circuit 10 at least comprises a driving transistor DTFT having a gate connected to a first node G, a first electrode connected to a first power supply voltage terminal ELVDD, and a second electrode connected to a light emitting unit 100. The light emitting unit 100 is connected to a second power supply voltage terminal ELVSS. By controlling a voltage applied to the gate of the driving transistor DTFT, the amount of current flowing through the light emitting unit 100 is controlled, so as to cause the light emitting unit 100 to emit light with different brightness.

As shown in FIG. 2, in the pixel driving circuit 10, the first power supply voltage terminal ELVDD may be a high-level voltage terminal, and the second power supply voltage terminal ELVSS may be a low-level voltage terminal.

It should be noted that FIG. 2 is merely an example in which the first electrode of the driving transistor DTFT is directly connected to the first power voltage terminal ELVDD, and the second electrode of the driving transistor DTFT is connected to the second power voltage terminal ELVSS directly through the OLED. However, the present disclosure is not limited to this. In some embodiments, a transistor may be provided between the first electrode of the driving transistor DTFT and the first power supply voltage terminal ELVDD, so as to control connection and disconnection between the first electrode of the driving transistor DTFT and the first power supply voltage terminal ELVDD through the transistor. In some embodiments, a transistor may be provided between the second electrode of the driving transistor DTFT and the OLED, so as to control connection and disconnection between the second electrode of the driving transistor DTFT and the OLED through the transistor.

In addition, as shown in FIG. 2, the pixel driving circuit 10 further comprises a switching subcircuit 101 connected to a first scanning terminal Scan1, the first node G and a data voltage terminal Data. The switching subcircuit 101 is configured to write the data voltage Vdata of the data voltage terminal Data into the first node G under control of a voltage of the first scanning terminal Scan1.

In some embodiments, as shown in FIG. 2, the switching subcircuit 101 may comprise a second transistor T2 having a gate connected to the first scanning terminal Scan1, a first electrode connected to the data voltage terminal Data, and a second electrode connected to the first node G. The second transistor T2 can be turned on under control of the voltage of the first scanning terminal Scan1, so as to write the data voltage Vdata of the data voltage terminal Data into the first node G.

As shown in FIG. 2, the pixel driving circuit 10 of the present disclosure further comprises a compensation subcircuit 200 connected to the first node G, a second scanning terminal Scan2, a first voltage terminal V1, and a reference voltage terminal $V_{ref}$.

According to an embodiment, the compensation subcircuit 200 is configured to control the voltage of the first node G by using a voltage of the second scanning terminal Scan2 before writing, by the switching subcircuit 101, the data voltage Vdata into the first node G, so as to turn off the driving transistor DTFT.

It can be understood that, during displaying of the display panel, the driving transistor DTFT is in an turned-on state in a previous image frame F(n) so as to drive the OLED to emit light normally, therefore, after entering a next image frame F(n+1) from the previous image frame F(n), the driving transistor DTFT may be firstly turned off by the compensation subcircuit 200 to be reset, and then the data voltage Vdata is written into the first node G, which can improve brightness accuracy of the OLED in the image frame.

According to an embodiment, the compensation subcircuit 200 is further configured to: after writing the data voltage Vdata to the first node G by the switching subcircuit 101, adjust the voltage of the first node G from the data voltage Vdata to an intermediate control voltage $V_{intermediate}$ associated with a threshold voltage Vth of the driving transistor DTFT under control of voltages of the second scanning terminal Scan2, the first voltage terminal V1 and the reference voltage terminal $V_{ref}$. Under control of continuously applied voltage of the second scanning terminal Scan2, the voltage of the first node G is adjusted from the intermediate control voltage $V_{intermediate}$ to a compensation data voltage $V_{compensation}$, so as to turn on the driving transistor DTFT to drive the OLED to emit light, and compensate for the threshold voltage Vth of the driving transistor DTFT.

In summary, according to the embodiment of the present disclosure, the pixel driving circuit 10 is provided with the compensation subcircuit 200. The compensation subcircuit 200 controls the driving transistor DTFT to be turned off to reset before the data voltage Vdata is written into the first node G, and adjusts the voltage of the first node G from the data voltage Vdata to the compensation data voltage $V_{compensation}$ after the data voltage Vdata is written into the first node G, so as to compensate for the threshold voltage Vth of the driving transistor DTFT while turning on the driving transistor DTFT to drive the light emitting unit (OLED) to emit light. That is, it is ensured that the brightness of the light emitting unit (OLED) is independent of the threshold voltage Vth of the driving transistor DTFT, thereby avoiding the problem of uneven brightness display screen caused by difference in the threshold voltage of the driving transistor in each pixel driving circuit in the display panel.

Figure 3:
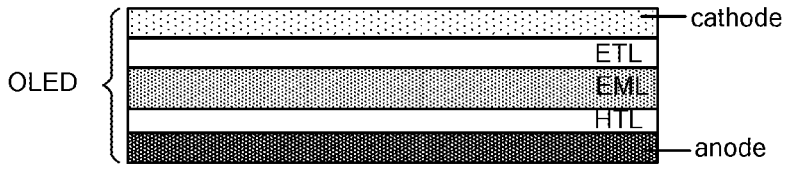
FIG. 3 is a schematic structural diagram of an OLED provided by an embodiment of the present disclosure.

In addition, the light emitting unit 100 in the embodiment of the present disclosure may be an organic light emitting diode OLED. FIG. 3 is a schematic structural diagram of an OLED provided by an embodiment of the present disclosure. As shown in FIG. 3, the OLED comprises a cathode and an anode, and a light emitting functional layer between the cathode and the anode. The light emitting functional layer may comprise an organic light emitting layer EML, a hole transport layer HTL between the organic light emitting layer EML and the anode, and an electron transport layer ETL between the organic light emitting layer EML and the cathode. Of course, according to needs, in some embodiments, a hole injection layer may be provided between the hole transport layer HTL and the anode, an electron injection layer may be provided between the electron transport layer ETL and the cathode, an electron blocking layer may be provided between the organic light emitting layer EML and the hole transport layer HTL, and a hole blocking layer may be provided between the organic light emitting layer EML and the electron transport layer ETL.

The light emitting principle of OLED is: during display, by controlling voltages applied to the anode and the cathode, holes are injected into the anode, and electrons are injected into the cathode, then the electrons and holes formed meet in the organic light emitting layer to generate excitons, thereby exciting the organic light emitting layer to emit light.

However, the embodiments of the present disclosure are not limited thereto, and the light emitting unit 100 may be other types of light emitting devices.

Figure 4:
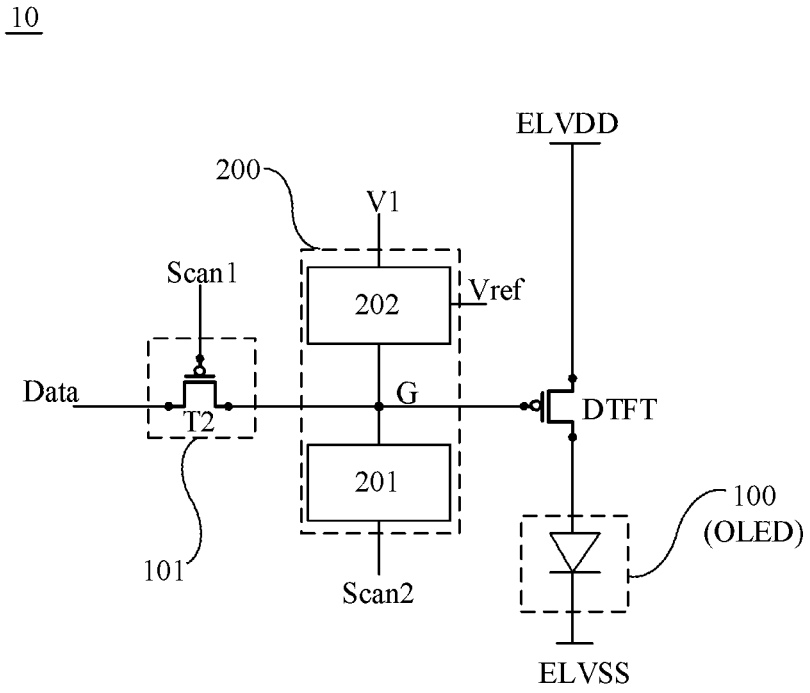
FIG. 4 is a schematic diagram of a pixel driving circuit provided by an embodiment of the present disclosure.

FIG. 4 is a schematic diagram of a pixel driving circuit provided by an embodiment of the present disclosure.

As shown in FIG. 4, the compensation subcircuit 200 may comprise a first compensation control subcircuit 201 and a second compensation control subcircuit 202.

As shown in FIG. 4, the first compensation control subcircuit 201 is connected to the second scanning terminal Scan2 and the first node G, and the second compensation control subcircuit 202 is connected to the first node G, the first voltage terminal V1, and the reference voltage terminal $V_{ref}$.

According to an embodiment, before the data voltage Vdata is written into the first node G by the switching subcircuit 101, the voltage of the first node G is controlled by the first compensation control subcircuit 201 under control of the voltage of the second scanning terminal Scan2, so as to turn off the driving transistor DTFT.

After the data voltage Vdata is written into the first node G by the switching subcircuit 101, the voltage of the first node G is adjusted, by the first compensation control subcircuit 201 and the second compensation control subcircuit 202, from the data voltage Vdata to the intermediate control voltage $V_{intermediate}$ associated with the threshold voltage Vth of the driving transistor DTFT under control of voltages of the second scanning terminal Scan2, the first voltage terminal V1 and the reference voltage terminal $V_{ref}$. Then, the voltage of the first node G is adjusted from the intermediate control voltage $V_{intermediate}$ to the compensation data voltage $V_{compensation}$ by the first compensation control subcircuit 201 under continuous control of the voltage of the second scanning terminal Scan2, so as to turn on the driving transistor and drive the OLED to emit light, and compensate for the threshold voltage Vth of the driving transistor DTFT.

Figure 5:
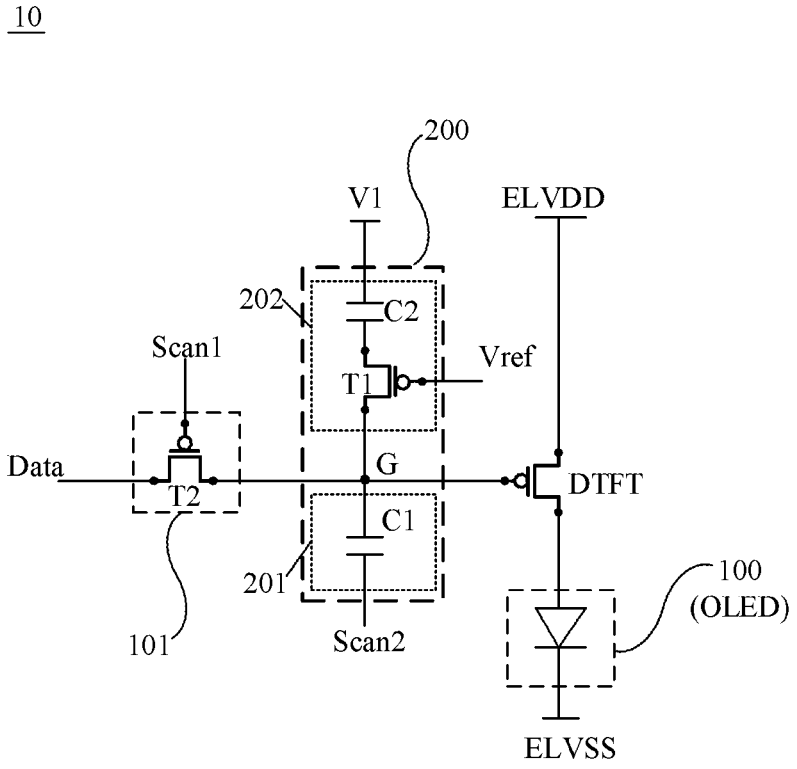
FIG. 5 is a schematic diagram of a pixel driving circuit provided by an embodiment of the present disclosure.

FIG. 5 is a schematic diagram of a pixel driving circuit provided by an embodiment of the present disclosure.

As shown in FIG. 5, the first compensation control subcircuit 201 may comprise a first capacitor C1 having a first electrode connected to the second scanning terminal Scan2 and a second electrode connected to the first node G. The second compensation control subcircuit 202 comprises a second capacitor C2 and a first transistor T1, where the second capacitor C2 has a first electrode connected to the first voltage terminal V1 and a second electrode connected to the first electrode of the first transistor T1, and the first transistor T1 has a gate connected to the reference voltage terminal Vref and a second electrode connected to the first node G.

According to an embodiment, the first capacitor C1 in the first compensation control subcircuit 201 and the second capacitor C2 in the second compensation control subcircuit 202 have equal capacitance. For further description below, the capacitance of the first capacitor C1 is also denoted by "C1", and the capacitance of the second capacitor C2 is also denoted by "C2", which should not be regarded as unclear. Therefore, the capacitance of the first capacitor C1 is equal to that of the second capacitor C2 can be expressed as C1=C2.

In some embodiments, when manufacturing the first capacitor C1 and the second capacitor C2, the first capacitor C1 and the second capacitor C2 may be designed to have the same characteristics, that is, the two have the same size, parameters, specifications, and the like, so as to ensure that the capacitance of the first capacitor C1 is equal to that of the second capacitor C2.

According to an embodiment, the first transistor T1 in the second compensation control subcircuit 202 has a threshold voltage Vth' which is the same as the threshold voltage Vth of the driving transistor DTFT, that is, Vth=Vth'.

In some embodiments, when manufacturing the first transistor T1 and the driving transistor DTFT, the first transistor T1 and the driving transistor DTFT may be designed to have the same characteristics, that is, the two have the same size, parameters, specifications, and the like, so as to ensure that the threshold voltage of the first transistor T1 is equal to that of the driving transistor DTFT, that is, Vth'=Vth.

Figure 6:
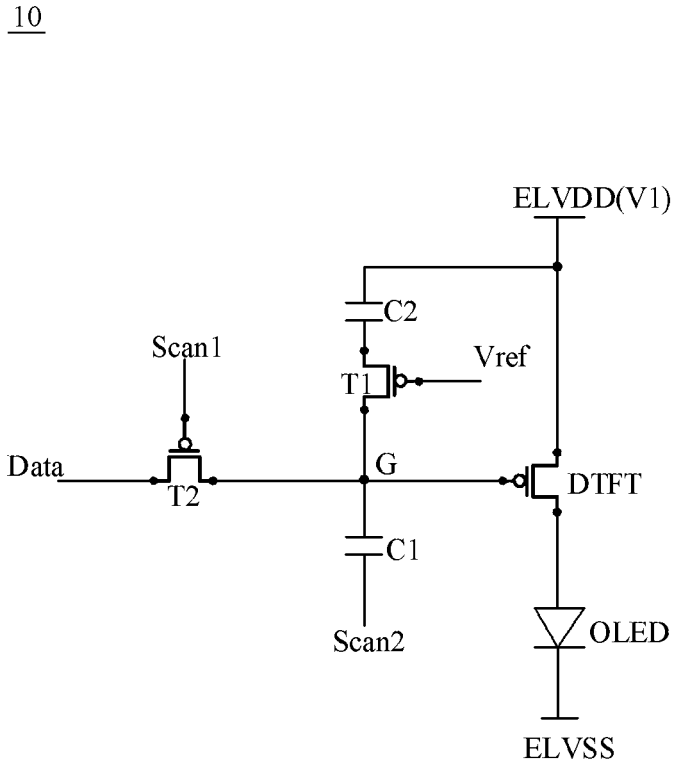
FIG. 6 is a schematic diagram of a pixel driving circuit provided by an embodiment of the present disclosure.

FIG. 6 is a schematic diagram of a pixel driving circuit provided by an embodiment of the present disclosure. As shown in FIG. 6, in some embodiments, in order to simplify wiring and control, the first voltage terminal V1 may be electrically connected to the first power supply voltage terminal ELVDD. However, the present disclosure is not limited to this.

Figure 7:
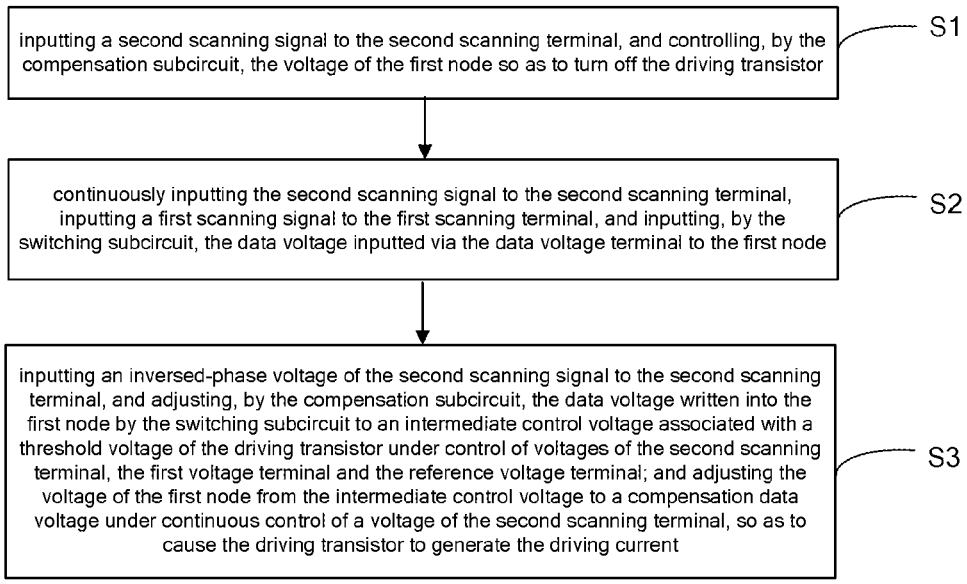
FIG. 7 is a schematic flowchart of a driving method of a pixel driving circuit provided by an embodiment of the present disclosure.

An embodiment of the present disclosure further provides a driving method of the pixel driving circuit 10. As shown in FIG. 7, the driving method comprises:

In step S1, inputting a second scanning signal to the second scanning terminal, and controlling, by the compensation subcircuit, the voltage of the first node so as to turn off the driving transistor.

In step S2, continuously inputting the second scanning signal to the second scanning terminal, inputting a first scanning signal to the first scanning terminal, and inputting, by the switching subcircuit, the data voltage inputted via the data voltage terminal to the first node.

In step S3, inputting an inversed-phase voltage of the second scanning signal to the second scanning terminal, and adjusting, by the compensation subcircuit, the data voltage written into the first node by the switching subcircuit to an intermediate control voltage associated with a threshold voltage of the driving transistor under control of voltages of the second scanning terminal, the first voltage terminal and the reference voltage terminal; and adjusting the voltage of the first node from the intermediate control voltage to a compensation data voltage under continuous control of a voltage of the second scanning terminal, so as to cause the driving transistor to generate the driving current.

Figure 8:
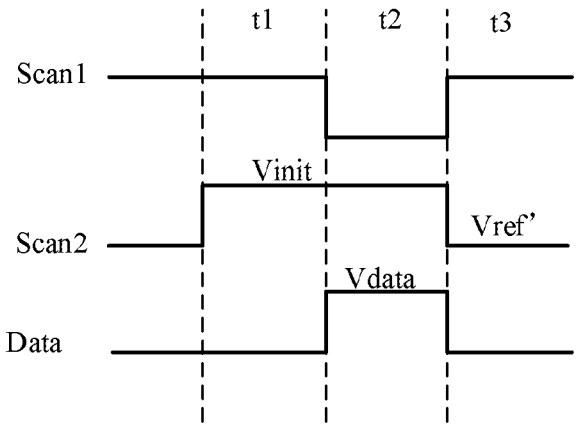
FIG. 8 is a driving timing diagram of a pixel driving circuit provided by an embodiment of the present disclosure.

The driving method is described below with reference to FIG. 7 in combination with FIG. 2 and FIG. 8. As shown in FIG. 8, the driving method comprises: a reset phase t1, a pixel data writing phase t2, and a light emitting phase t3.

During the Reset Phase t1:

The second scanning signal, that is, the initial voltage $V_{init}$, is input to the second scanning terminal Scan2, and the voltage of the first node G1 is controlled by the compensation subcircuit 200, so as to turn off the driving transistor DTFT to reset.

In the embodiment shown in FIG. 3 where the compensation subcircuit 200 comprises the first compensation control subcircuit 201 and the second compensation control subcircuit 202, the reset phase t1 may comprise: inputting the second scanning signal $V_{init}$ to the second scanning terminal Scan2, and controlling the voltage of the first node G1 by the first compensation control subcircuit 201, so as to turn off the driving transistor DTFT to reset.

During the Pixel Data Writing Phase t2:

The second scanning signal $V_{init}$ is continuously input to the second scanning terminal Scan2, and the first scanning signal is input to the first scanning terminal Scan1, the switching subcircuit 101 is turned on, and the data voltage Vdata input from the data voltage terminal Data is input to the first node G.

During the Light Emitting Phase t3:

The inversed-phase voltage of the second scanning signal is input to the second scanning terminal Scan 2, and under the control of the voltages of the first voltage terminal V1 and the reference voltage terminal Vref, the voltage of the first node G is adjusted, by using the compensation subcircuit 200, from the data voltage Vdata of the pixel data writing phase t3 to the intermediate control voltage $V_{intermediate}$ associated with the threshold voltage Vth of the driving transistor DTFT. Under the continuous control of the voltage of the second scanning terminal Scan 2, the voltage of the first node G is adjusted from the intermediate control voltage $V_{intermediate}$ to the compensation data voltage $V_{compensation}$, so as to turn on the driving transistor DTFT to drive the OLED to emit light, and compensate for the threshold voltage Vth of the driving transistor DTFT.

In the embodiment where the compensation subcircuit 200 comprises the first compensation control subcircuit 201 and the second compensation control subcircuit 202, in the light emitting phase t3, the inversed-phase voltage of the second scanning signal is input to the second scanning terminal Scan2, and under the control of the voltages of the first voltage terminal V1 and the reference voltage terminal Vref, the voltage of the first node G is adjusted, by using the first compensation control subcircuit 201 and the second compensation control subcircuit 202, from the data voltage Vdata of the pixel data writing phase t2 to the intermediate control voltage $V_{intermediate}$, and under the continuous control of the voltage of the second scanning terminal Scan2, the voltage of the first node G is adjusted from the intermediate control voltage $V_{intermediate}$ to the compensation data voltage $V_{compensation}$ by using the first compensation control subcircuit 201, so as to turn on the driving transistor DTFT, thereby driving the OLED to emit light, and compensating for the threshold voltage Vth of the driving transistor DTFT.

It should be noted that the inversed-phase voltage of the second scanning signal refers to: when the second scanning signal is a high-level voltage, the inversed-phase voltage of the second scanning signal is a low-level voltage; when the second scanning signal is a low-level voltage, the inversed-phase voltage of the second scanning signal is a high-level voltage.

The driving process of the pixel driving circuit 10 during each phase will be further described below in combination with turning on and turning off each transistor by taking the pixel driving circuit 10 shown in FIG. 4 as an example and referring to the driving timing of FIG. 8.

During the entire driving process, the first voltage terminal V1 and the reference voltage terminal Vref are constant voltage terminals, and the voltage of the reference voltage terminal Vref is represented by $V_{ref}$.

During the Reset Phase t1:

The second scanning signal of high-level voltage is input to the second scanning terminal Scan2, that is, $V_{init}$ is a high-level voltage. Under the control of the high-level voltage, the voltage of the first node G is raised by the coupling and bootstrap effect of the first capacitor C1, thereby turning off the driving transistor DTFT to reset. At the same time, in the reset phase t1, the first capacitor C1 is charged.

During the Pixel Data Writing Phase t2:

The second scanning signal $V_{init}$ of high-level voltage is continuously input to the second scanning terminal Scan2, and the first scanning signal of low-level voltage is input to the first scanning terminal Scan1, then the second transistor T2 is turned on, and the data voltage Vdata input by the data voltage terminal Data is input to the first node G.

During the light emitting phase t3: First, before entering the light emitting phase t3 (that is, in the reset phase t1 and the pixel data writing phase t2), the first transistor T1 remains on under the control of the voltage $V_{ref}$ of the reference voltage terminal Vref.

After entering the light emitting phase t3, the voltage input to the second scanning terminal Scan2 changes from the high-level voltage $V_{init}$ to a low-level voltage $V_{ref}'$ (that is, the inversed-phase voltage of the second scanning signal). In this case, the driving process of the pixel driving circuit 10 in the light emitting phase t3 may be divided into a first phase t3_1 and a second phase t3_2.

During the first phase t3_1, at the initial stage of the second scanning terminal Scan2 changing from the high-level voltage $V_{init}$ to the low-level voltage $V_{ref}'$, the voltage of the first node G decreases gradually from the data voltage Vdata of the pixel data writing phase t2 under the coupling effect of the first capacitor C1, and the first transistor T1 changes from the on state to the off state. When the first transistor T1 is turned off, the voltage of the first node G drops to the intermediate control voltage $V_{intermediate}=V_{ref}-Vth'$. In the process of the first transistor T1 changing from the on state to the off state, the charges stored in the first capacitor C1 and the second capacitor C2 are redistributed.

Before the first transistor is turned off, the voltage of the first electrode of the first capacitor C1 can be obtained by redistributing the charges stored in the first capacitor C1 and the second capacitor C2, when the value of the voltage is not equal to the voltage $V_{ref}'$ applied to the second scanning terminal Scan2, the first capacitor C1 may further adjust the voltages at both ends.

During the second phase t3_2, the first capacitor C1 continues to adjust the voltage of its first electrode (that is, the plate connected to the second scanning terminal Scan2) until the voltage of the first electrode of the first capacitor C1 reaches the low-level voltage $V_{ref}'$ applied to the second scanning terminal Scan2, and reaches a stable equilibrium state.

According to the embodiment, since the capacitor itself has the inertia of maintaining the voltage constant at both ends, the voltage on the two plates of the first capacitor C1 shall remain unchanged throughout the light emitting phase t3, that is to say, the voltage variations on the two plates of the first capacitor C1 are the same, that is:

$$V'_{ref} - V_{init} = \frac{C1 + C2}{C1}(V_{ref} - Vth' - Vdata) + [V_{compensation} - (V_{ref} - Vth')].$$

On this basis, as can be seen from the foregoing contents, since C1=C2, Vth'=Vth, then $v_{compensation}=2Vdata-V_{init}+Vth+V_{ref}'-V_{ref}$. At this time, the driving current I flowing through the OLED meets:

$$I = \frac{1}{2}\mu_n Cox\frac{W}{L}(V_{GS} - Vth)^2 = \frac{1}{2}\mu_n Cox\frac{W}{L}(2Vdata - V_{init} + V'_{ref} - V_{ref} - V_{ELVDD})^2.$$

Therefore, the driving current I flowing through the OLED is independent of the threshold voltage Vth of the driving transistor DTFT. In the previous equation, $\mu_n$, Cox and $\frac{W}{L}$ are respectively the carrier mobility, the gate oxide layer capacitance and the channel width-to-length ratio of the driving transistor DTFT, which are all determined parameters, $V_{ELVDD}$ is the voltage of the first power supply voltage terminal, and $V_{ELVDD}$, $V_{init}$, $V_{ref}'$ and $V_{ref}$ are all known parameters.

Of course, in order to simplify the control and avoid separately providing the circuits that generate $V_{ref}'$ and $V_{ref}$, in some embodiments, $V_{ref}'=V_{ref}$ may be set, that is, $V_{ref}'$ and $V_{ref}$ may adopt the same conversion circuit.

It can be understood that in the case of setting $V_{ref}'=V_{ref}$, the driving current I flowing through the OLED meets:

$$I = \frac{1}{2}\mu_n Cox\frac{W}{L}(2Vdata - V_{init} - V_{ELVDD})^2.$$

In addition, the relative magnitude between the data voltage Vdata and other voltages will be described below.

For the driving transistor DTFT, in the reset phase t1 and the pixel data writing phase t2, the driving transistor DTFT is in the off state, then $Vdata-V_{ELVDD}\geq Vth$, that is, $Vdata\geq Vth+V_{ELVDD}$. In the light emitting phase t3, the driving transistor DTFT is turned on, then $2Vdata-V_{init}-V_{ELVDD}+Vth\leq Vth$, that is, $Vdata\leq\frac{1}{2}(V_{init}+V_{ELVDD})$. In other words, $Vth+V_{ELVDD}\leq Vdata\leq\frac{1}{2}(V_{init}+V_{ELVDD})$.

For the first transistor T1, in the reset phase t1 and the pixel data writing phase t2, the first transistor T1 is in the on state, then $V_{ref}-Vdata\leq Vth'$, that is, $Vdata\geq V_{ref}-Vth'$. In the light emitting phase t3, the first transistor T1 is in the off state, then $V_{ref}-(2Vdata-V_{init}-V_{ELVDD}+Vth')\geq Vth'$, that is, $Vdata\leq\frac{1}{2}(V_{ref}+V_{init})-Vth'$. In other words, $V_{ref}-Vth'\leq Vdata\leq\frac{1}{2}(V_{ref}+V_{init})-Vth'$.

The turning on and off processes of the transistors in the above embodiments of the present disclosure are described by taking P-type transistors as examples, and the transistors in the embodiments of the present disclosure may also be of N-type. When all transistors are of N-type, it is necessary to invert each control signal.

It should be noted that the source and drain of the above transistor are usually symmetrical in structure and composition, so there is no difference between the source and drain. In some embodiments of the present disclosure, in order to distinguish the two electrodes of a transistor other than the gate, one of the electrodes is called a source and the other is called a drain.

Figure 9:
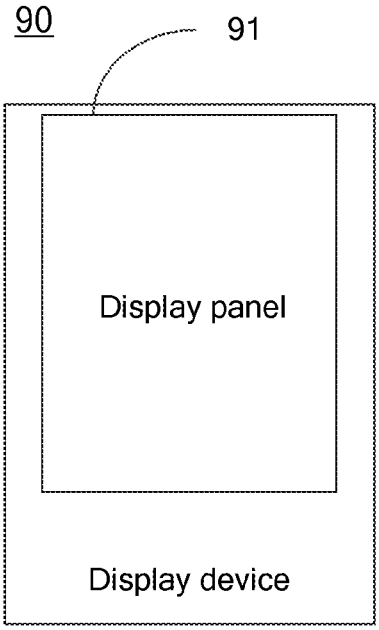
FIG. 9 is a schematic diagram of a display device provided by an embodiment of the present disclosure.

FIG. 9 is a schematic diagram of a display device provided by an embodiment of the present disclosure. As shown in FIG. 9, the display device 90 according to the embodiment of the present disclosure comprises a display panel 91. The display panel 91 may have the structure of the display panel 001 in the above-described embodiments, which will not be repeated here. The display device 90 according to the embodiment of the present disclosure may be any product or component having a display function, such as an electronic paper, a mobile phone, a tablet computer, a television, a display, a notebook computer, a digital photo frame, a navigator, and the like.

Those ordinary skilled in the art may understand that all or part of the steps to implement the above method embodiments may be performed by program instructions related hardware. The above-mentioned program may be stored in a computer-readable storage medium, and when the program is executed, the steps including the above method embodiments are performed; and the above-mentioned storage medium include various medium that can store program codes, such as ROM, RAM, magnetic disks, or optical disks.

The above are only the specific embodiments of the present disclosure, but the scope of protection of the present disclosure is not limited to this. Any changes or substitutions envisaged by those skilled in the art within the technical scope disclosed by the present disclosure shall be covered by the protection scope of the present disclosure. Therefore, the protection scope of the present disclosure shall be determined by the protection scope of the claims.

The invention claimed is:

1. A pixel driving circuit, comprising:

a driving transistor having a gate connected to a first node, a first electrode connected to a first power supply voltage terminal, and a second electrode connected to one end of a light emitting unit, the driving transistor being configured to generate a driving current that causes the light emitting unit to emit light under control of a voltage of the first node;

a switching subcircuit connected to a first scanning terminal, the first node and a data voltage terminal, the switching subcircuit being configured to write a data voltage of the data voltage terminal into the first node under control of a voltage of the first scanning terminal;

a compensation subcircuit connected to the first node, a second scanning terminal, a first voltage terminal and a reference voltage terminal, the compensation subcircuit being configured to:

control the voltage of the first node under control of a voltage of the second scanning terminal, so as to turn off the driving transistor; adjust the data voltage written into the first node by the switching subcircuit to an intermediate control voltage associated with a threshold voltage of the driving transistor under control of voltages of the second scanning terminal, the first voltage terminal and the reference voltage terminal; and adjust the voltage of the first node from the intermediate control voltage to a compensation data voltage under continuous control of a voltage of the second scanning terminal, so as to cause the driving transistor to generate the driving current.

2. The pixel driving circuit according to claim 1, wherein the compensation subcircuit comprises:

a first compensation control subcircuit connected to the second scanning terminal and the first node; and a second compensation control subcircuit connected to the first node, the first voltage terminal and the reference voltage terminal.

3. The pixel driving circuit according to claim 2, wherein the first compensation control subcircuit comprises a first capacitor having a first electrode connected to the second scanning terminal and a second electrode connected to the first node.

4. The pixel driving circuit according to claim 3, wherein the second compensation control subcircuit comprises:

a second capacitor having a first electrode connected to the first voltage terminal and a second electrode connected to a first electrode of a first transistor; and the first transistor having a gate connected to the reference voltage terminal and a second electrode connected to the first node.

5. The pixel driving circuit according to claim 4, wherein the first capacitor has capacitance equal to that of the second capacitor.

6. The pixel driving circuit according to claim 4, wherein the first transistor has a threshold voltage the same as that of the driving transistor.

7. The pixel driving circuit according to claim 6, wherein the first transistor has size and parameters the same as that of the driving transistor.

8. The pixel driving circuit according to claim 1, wherein the light emitting unit is an organic light emitting diode having an anode connected to the second electrode of the driving transistor and a cathode connected to a second power supply voltage terminal.

9. The pixel driving circuit according to claim 1, wherein the switching subcircuit comprises a second transistor having a gate connected to the first scanning terminal, a first electrode connected to the data voltage terminal and a second electrode connected to the first node.

10. A display panel comprising the pixel driving circuit according to claim 1.

11. A display device comprising the display panel according to claim 10.

12. A driving method of a pixel driving circuit, the pixel driving circuit comprising:

a driving transistor having a gate connected to a first node, a first electrode connected to a first power supply voltage terminal, and a second electrode connected to one end of a light emitting unit, the driving transistor being configured to generate a driving current that causes the light emitting unit to emit light under control of a voltage of the first node;

a switching subcircuit connected to a first scanning terminal, the first node and a data voltage terminal, the switching subcircuit being configured to write a data voltage of the data voltage terminal into the first node under control of a voltage of the first scanning terminal;

a compensation subcircuit connected to the first node, a second scanning terminal, a first voltage terminal and a reference voltage terminal, the compensation subcircuit being configured to:

control the voltage of the first node under control of a voltage of the second scanning terminal, so as to turn off the driving transistor; adjust the data voltage written into the first node by the switching subcircuit to an intermediate control voltage associated with a threshold voltage of the driving transistor under control of voltages of the second scanning terminal, the first voltage terminal and the reference voltage terminal; and adjust the voltage of the first node from the intermediate control voltage to a compensation data voltage under continuous control of a voltage of the second scanning terminal, so as to cause the driving transistor to generate the driving current, the driving method comprising:

during a reset phase:

inputting a second scanning signal to the second scanning terminal, and controlling, by the compensation subcircuit, the voltage of the first node so as to turn off the driving transistor;

during a pixel data writing phase:

continuously inputting the second scanning signal to the second scanning terminal;

inputting a first scanning signal to the first scanning terminal, and inputting, by the switching subcircuit, the data voltage inputted via the data voltage terminal to the first node;

during a light emitting phase:

inputting an inversed-phase voltage of the second scanning signal to the second scanning terminal, and adjusting, by the compensation subcircuit, the data voltage written into the first node by the switching subcircuit to an intermediate control voltage associated with a threshold voltage of the driving transistor under control of voltages of the second scanning terminal, the first voltage terminal and the reference voltage terminal; and adjusting the voltage of the first node from the intermediate control voltage to a compensation data voltage under continuous control of a voltage of the second scanning terminal, so as to cause the driving transistor to generate the driving current.

13. The driving method according to claim 12, wherein in the case where the compensation subcircuit in the pixel driving circuit comprises a first compensation control subcircuit and a second compensation control subcircuit, inputting the second scanning signal to the second scanning terminal, and controlling, by the compensation subcircuit, the voltage of the first node so as to turn off the driving transistor comprises:

inputting the second scanning signal to the second scanning terminal, and controlling, by the first compensation control subcircuit, the voltage of the first node so as to turn off the driving transistor;

inputting an inversed-phase voltage of the second scanning signal to the second scanning terminal, and adjusting, by the compensation subcircuit, the data voltage written into the first node by the switching subcircuit to an intermediate control voltage associated with a threshold voltage of the driving transistor under control of voltages of the second scanning terminal, the first voltage terminal and the reference voltage terminal; and adjusting the voltage of the first node from the intermediate control voltage to a compensation data voltage under continuous control of a voltage of the second scanning terminal, so as to cause the driving transistor to generate the driving current comprises:

inputting the inversed-phase voltage of the second scanning signal to the second scanning terminal, and adjusting, by the first compensation control subcircuit and the second compensation control subcircuit, the data voltage written into the first node by the switching subcircuit to an intermediate control voltage associated with a threshold voltage of the driving transistor under control of voltages of the second scanning terminal, the first voltage terminal and the reference voltage terminal; and adjusting, by the first compensation control subcircuit, the voltage of the first node from the intermediate control voltage to a compensation data voltage under continuous control of a voltage of the second scanning terminal, so as to cause the driving transistor to generate the driving current to drive the light emitting unit to emit light, and compensate for the threshold voltage of the driving transistor.

14. The driving method according to claim 12, wherein a value of the data voltage meets:

$$Vth+V_{ELVDD}\leq Vdata\leq \tfrac{1}{2}(V_{init}+V_{ELVDD})$$

wherein, Vdata represents the data voltage, Vth represents the threshold voltage of the driving transistor, $V_{ELVDD}$ represents the voltage of the first power supply voltage terminal, and $V_{init}$ represents the voltage of the second scanning terminal.

15. The driving method according to claim 12, wherein a value of the data voltage meets:

$$V_{ref}-Vth'\leq Vdata\leq \tfrac{1}{2}(V_{ref}+V_{init})-Vth'$$

wherein, Vdata represents the data voltage, $V_{ref}$ represents the voltage of the reference voltage terminal, Vth' represents a threshold voltage of a first transistor, and $V_{init}$ represents the voltage of the second scanning terminal.

* * * * *